US007686707B2

(12) United States Patent
Matsunaga et al.

(10) Patent No.: US 7,686,707 B2
(45) **Date of Patent: *Mar. 30, 2010**

(54) GOLF CLUB HEAD

(75) Inventors: Hideo Matsunaga, Saitama (JP); Wataru Ban, Saitama (JP); Hideo Shimazaki, Tokyo (JP)

(73) Assignee: Bridgestone Sports Co., Ltd., Shinagawa-ku, Tokyo (JP)

( * ) Notice: Subject to any disclaimer, the term of this patent is extended or adjusted under 35 U.S.C. 154(b) by 7 days.

This patent is subject to a terminal disclaimer.

(21) Appl. No.: 11/434,899

(22) Filed: May 17, 2006

(65) Prior Publication Data

US 2007/0129160 A1 Jun. 7, 2007

(30) Foreign Application Priority Data

Dec. 5, 2005 (JP) ..... 2005-351280

(51) Int. Cl.
*A63B 53/04* (2006.01)

(52) U.S. Cl. ..... 473/332; 473/345; 473/350

(58) Field of Classification Search ..... 473/324–350
See application file for complete search history.

(56) References Cited

U.S. PATENT DOCUMENTS

| | | | | |
|---|---|---|---|---|
| 2,846,228 | A | 8/1958 | Reach | |
| 3,084,940 | A | 4/1963 | Cissel | |
| 4,804,188 | A | 2/1989 | McKee et al. | |
| 4,811,950 | A | 3/1989 | Kobayashi | |
| 4,928,972 | A | 5/1990 | Nakanishi et al. | |
| 5,290,036 | A * | 3/1994 | Fenton et al. | 473/332 |
| 5,299,807 | A | 4/1994 | Hutin | |
| 5,316,298 | A | 5/1994 | Hutin et al. | |
| 5,316,305 | A | 5/1994 | McCabe | |
| 5,351,958 | A | 10/1994 | Helmstetter | |
| 5,362,055 | A | 11/1994 | Rennie | |
| 5,409,229 | A | 4/1995 | Schmidt et al. | |
| 5,411,255 | A | 5/1995 | Kurashima et al. | |
| 5,431,396 | A | 7/1995 | Shieh | |
| 5,492,327 | A | 2/1996 | Biafore, Jr. | |
| 5,529,543 | A | 6/1996 | Beaumont, Sr. | |
| 5,564,705 | A | 10/1996 | Kbbayashi et al. | |
| 5,586,947 | A | 12/1996 | Hutin | |
| 5,643,111 | A | 7/1997 | Igarashi | |
| 5,692,972 | A | 12/1997 | Langslet | |

(Continued)

FOREIGN PATENT DOCUMENTS

| | | | |
|---|---|---|---|
| CN | 1469900 | A | 1/2004 |

(Continued)

OTHER PUBLICATIONS

U.S. Appl. No. 11/435,984, Hideo Matsunaga, filed May 18, 2006.

(Continued)

*Primary Examiner*—Alvin A Hunter
(74) *Attorney, Agent, or Firm*—Sughrue Mion, PLLC

(57) ABSTRACT

This invention provides a hollow golf club head having a first viscoelastic body made of a first viscoelastic material and a second viscoelastic body made of a second viscoelastic material with a loss coefficient the temperature dependence of which is different from that of a loss coefficient of the first viscoelastic material.

5 Claims, 4 Drawing Sheets

U.S. PATENT DOCUMENTS

| | | | | |
|---|---|---|---|---|
| 5,697,855 | A | 12/1997 | Aizawa | |
| 5,703,294 | A | 12/1997 | McConnell et al. | |
| 5,766,092 | A | 6/1998 | Mimeur et al. | |
| 5,766,093 | A | 6/1998 | Rohrer | |
| 6,045,456 | A | 4/2000 | Best et al. | |
| 6,093,116 | A | 7/2000 | Hettinger et al. | |
| 6,265,475 | B1 | 7/2001 | Chifei et al. | |
| 6,302,807 | B1 | 10/2001 | Rohrer | |
| 6,431,997 | B1 | 8/2002 | Rohrer | |
| 6,616,546 | B2 | 9/2003 | Cho | |
| 6,642,308 | B2 * | 11/2003 | Nomura et al. | 525/93 |
| 6,672,975 | B1 | 1/2004 | Galloway | |
| 6,688,989 | B2 * | 2/2004 | Best | 473/332 |
| 6,743,114 | B2 | 6/2004 | Best | |
| 6,743,117 | B2 | 6/2004 | Gilbert | |
| 6,773,360 | B2 | 8/2004 | Willett et al. | |
| 6,780,123 | B2 | 8/2004 | Hasebe | |
| 6,835,144 | B2 | 12/2004 | Best | |
| 6,855,066 | B2 | 2/2005 | Best | |
| 6,902,495 | B2 | 6/2005 | Pergande et al. | |
| 6,984,180 | B2 | 1/2006 | Hasebe | |
| 6,991,559 | B2 * | 1/2006 | Yabu | 473/332 |
| 6,991,560 | B2 | 1/2006 | Tseng | |
| 7,048,647 | B2 | 5/2006 | Burrows | |
| 7,108,613 | B1 | 9/2006 | Gordon et al. | |
| 7,119,146 | B2 * | 10/2006 | Tse et al. | 525/70 |
| 7,182,698 | B2 | 2/2007 | Tseng | |
| 7,189,169 | B2 | 3/2007 | Billings | |
| 7,207,899 | B2 | 4/2007 | Imamoto | |
| 7,226,366 | B2 | 6/2007 | Galloway | |
| 7,303,485 | B2 | 12/2007 | Tseng | |
| 7,303,486 | B2 | 12/2007 | Imamoto | |
| 7,316,623 | B2 | 1/2008 | Imamoto | |
| 7,371,190 | B2 | 5/2008 | Gilbert et al. | |
| 2003/0027662 | A1 | 2/2003 | Werner et al. | |
| 2003/0092502 | A1 | 5/2003 | Pergande et al. | |
| 2004/0043830 | A1 | 3/2004 | Imamoto | |
| 2004/0053704 | A1 | 3/2004 | Gilbert | |
| 2004/0242339 | A1 | 12/2004 | Gilbert et al. | |
| 2005/0124437 | A1 | 6/2005 | Imamoto | |
| 2005/0148405 | A1 | 7/2005 | Imamoto | |
| 2005/0192116 | A1 | 9/2005 | Imamoto | |
| 2005/0197208 | A1 | 9/2005 | Imamoto | |
| 2006/0258480 | A1 | 11/2006 | Hou et al. | |
| 2007/0049400 | A1 | 3/2007 | Imamoto et al. | |
| 2007/0129160 | A1 | 6/2007 | Matsunaga et al. | |
| 2007/0129161 | A1 | 6/2007 | Matsunaga et al. | |
| 2007/0129162 | A1 | 6/2007 | Pan et al. | |
| 2007/0129164 | A1 | 6/2007 | Shimazaki et al. | |
| 2007/0129165 | A1 | 6/2007 | Matsunaga et al. | |
| 2007/0129166 | A1 | 6/2007 | Shimazaki et al. | |
| 2007/0129168 | A1 | 6/2007 | Matsunaga et al. | |
| 2007/0149313 | A1 | 6/2007 | Matsunaga et al. | |
| 2008/0020860 | A1 | 1/2008 | Imamoto | |

FOREIGN PATENT DOCUMENTS

| | | | |
|---|---|---|---|
| EP | 1757334 | A1 * | 2/2007 |
| FR | 2717701 | A1 | 9/1995 |
| JP | 01-166779 | A | 6/1989 |
| JP | 05-028361 | U | 4/1993 |
| JP | 05147096 | A | 6/1993 |
| JP | 06-007486 | A | 1/1994 |
| JP | 06254183 | A | 9/1994 |
| JP | 06-319836 | A | 11/1994 |
| JP | 07-27630 | U | 5/1995 |
| JP | 07-148291 | A | 6/1995 |
| JP | 07-213656 | A | 8/1995 |
| JP | 08-206258 | A | 8/1996 |
| JP | 09-000666 | A | 1/1997 |
| JP | 09-122281 | A | 5/1997 |
| JP | 11114112 | A | 4/1999 |
| JP | 2000-116824 | A | 4/2000 |
| JP | 2000197718 | A | 7/2000 |
| JP | 2001000606 | A | 1/2001 |
| JP | 2001-170225 | A | 6/2001 |
| JP | 2004-313777 | A | 11/2001 |
| JP | 2003-093550 | A | 4/2003 |
| JP | 2003-102877 | A | 4/2003 |
| JP | 2003-250939 | A | 9/2003 |
| JP | 2003-265652 | A | 9/2003 |
| JP | 2003-265653 | A | 9/2003 |
| JP | 2003260153 | A | 9/2003 |
| JP | 2004-089434 | A | 3/2004 |
| JP | 2005-006763 | A | 1/2005 |
| JP | 2005-160947 | A | 6/2005 |
| JP | 2005-160948 | A | 6/2005 |
| JP | 3112038 | U | 6/2005 |
| JP | 2005-218510 | A | 8/2005 |
| JP | 2005-245519 | A | 9/2005 |
| JP | 2006000139 | A | 1/2006 |
| JP | 2006000435 | A | 1/2006 |
| WO | 9920358 | A1 | 4/1999 |
| WO | 0232994 | A2 | 4/2002 |

OTHER PUBLICATIONS

U.S. Appl. No. 11/435,989, Hideo Matsunaga, filed May 18, 2006.
U.S. Appl. No. 11/455,739, Hideo Matsunaga, filed Jun. 20, 2006.
U.S. Appl. No. 11/474,419, Hideo Shimazaki, filed Jun. 26, 2006.
U.S. Appl. No. 11/451,401, Hideo Shimazaki, filed Jun. 13, 2006.
U.S. Appl. No. 11/434,191, Hideo Matsunaga, filed May 16, 2006.

* cited by examiner

GOLF CLUB HEAD

FIELD OF THE INVENTION

The present invention relates to a golf club head and, more particularly, to a technique for controlling vibration of a golf club head by a viscoelastic body.

BACKGROUND OF THE INVENTION

A golf club head having a viscoelastic body has been proposed to improve the hitting impression or adjust the hitting sound on impact. When the viscoelastic body is attached, the vibration on impact is absorbed by the viscoelastic body to improve the hitting impression and decrease the hitting sound that is offensive to the player's ear. Japanese Utility Model Registration No. 3112038 discloses a golf club head having a plurality of types of elastic weights having different specific gravities and elasticities. Japanese Patent Laid-Open No. 2004-313777 discloses a golf club head having a plurality of types of elastic bodies having different hardnesses.

The present inventors inspected the resonance frequency of a golf club head alone. A plurality of resonance frequencies were confirmed in a range of approximately 4,000 Hz to 10,000 Hz. Therefore, to reduce the vibration of the golf club head effectively, it is desired to attach a viscoelastic body that can reduce the vibration within a wide frequency range to the golf club head. In general, however, there is a limit to the frequency range of a viscoelastic material that is effective to reduce vibration depending on the material. The present inventors also inspected the resonance frequency of the golf club as a whole. A plurality of resonance frequencies were confirmed in a range of approximately 2,000 Hz or less. Therefore, to reduce the vibration of the golf club as a whole, the vibration is preferably reduced within a wider frequency range.

SUMMARY OF THE INVENTION

The present invention has been made in order to overcome the deficits of prior art.

According to the aspects of the present invention, there is provided a hollow golf club head having a first viscoelastic body made of a first viscoelastic material and a second viscoelastic body made of a second viscoelastic material with a loss coefficient a temperature dependence of which is different from that of a loss coefficient of the first viscoelastic material.

The temperature dependence of the loss coefficient (so-called tan δ) of a viscoelastic material represents the degree of the vibration attenuating effect of the viscoelastic material at any given temperature, and is related to the degree of the vibration attenuating effect of the viscoelastic material at any given frequency. More specifically, relatively, whereas a viscoelastic material with a large loss coefficient at a low temperature provides a high vibration attenuating effect in a high frequency band, a viscoelastic material with a large loss coefficient at a high temperature provides a high vibration attenuating effect in a low frequency band.

Therefore, a plurality of types of viscoelastic materials with loss coefficients the temperature dependences of which are different are employed simultaneously, to reduce vibration in a wider frequency range.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Figure 1:
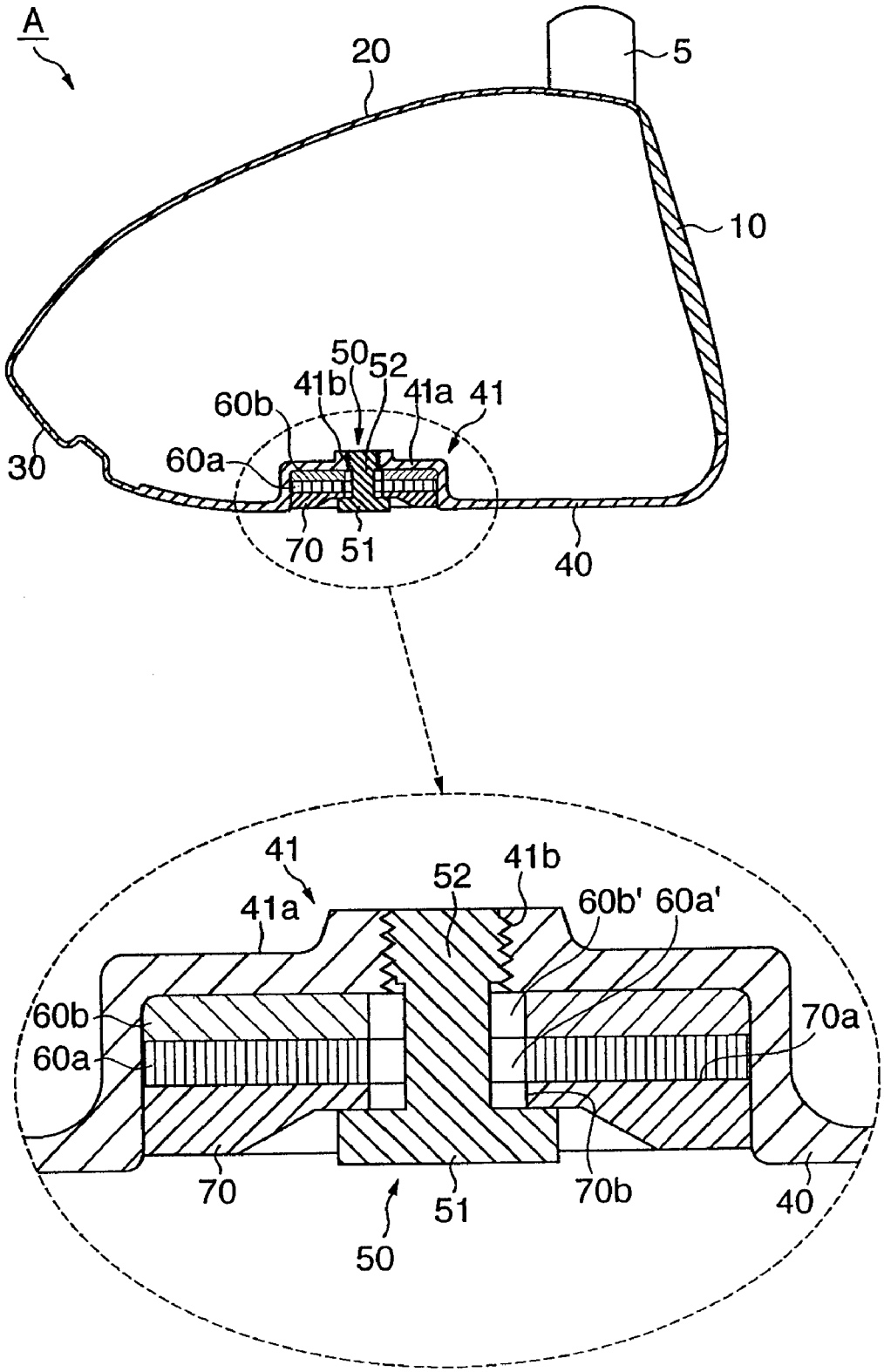
FIG. 1 includes a sectional view showing the structure of a golf club head A according to an embodiment of the present invention, and an enlarged view of the main part of the same.

FIG. 1 includes a sectional view showing the structure of a golf club head A according to an embodiment of the present invention, and an enlarged view of the main part of the same. The golf club head A forms a hollow body, and its circumferential wall constitutes a face portion 10 which forms a golf ball hitting surface, a crown portion 20 which forms the upper surface of the golf club head A, a side portion 30 (only the back side is shown) which forms the toe-side, heel-side, and back-side side surfaces of the golf club head A, and a sole portion 40 which forms the bottom surface of the golf club head A. The golf club head A is also provided with a hosel portion 5 to which a shaft is to be fixed. The golf club head A is desirably made of, e.g., a titanium-based metal material.

Although the golf club head A is a golf club head that is to be used as a driver, the present invention can be applied to a wood type golf club head including a fairway wood or the like other than the driver as well, a utility type golf club head, and other hollow golf club heads.

A recess portion 41 extending into the golf club head A is integrally formed in the sole portion 40, and viscoelastic bodies 60*a* and 60*b* are disposed in the recess portion 41. The recess portion 41 forms a fixing portion where the viscoelastic bodies 60*a* and 60*b* are to be stacked and fixed. Although the outline of the side wall of the recess portion 41 forms a circle in this embodiment, the shape of the recess portion 41 is not limited to this, but the outline of the side wall of the recess portion 41 can form an ellipse or a shape having corners. A screw hole 41*b* is formed in a bottom portion 41*a* of the recess portion 41. The screw hole 41*b* is located substantially at the center of the bottom portion 41*a*.

Figure 2:
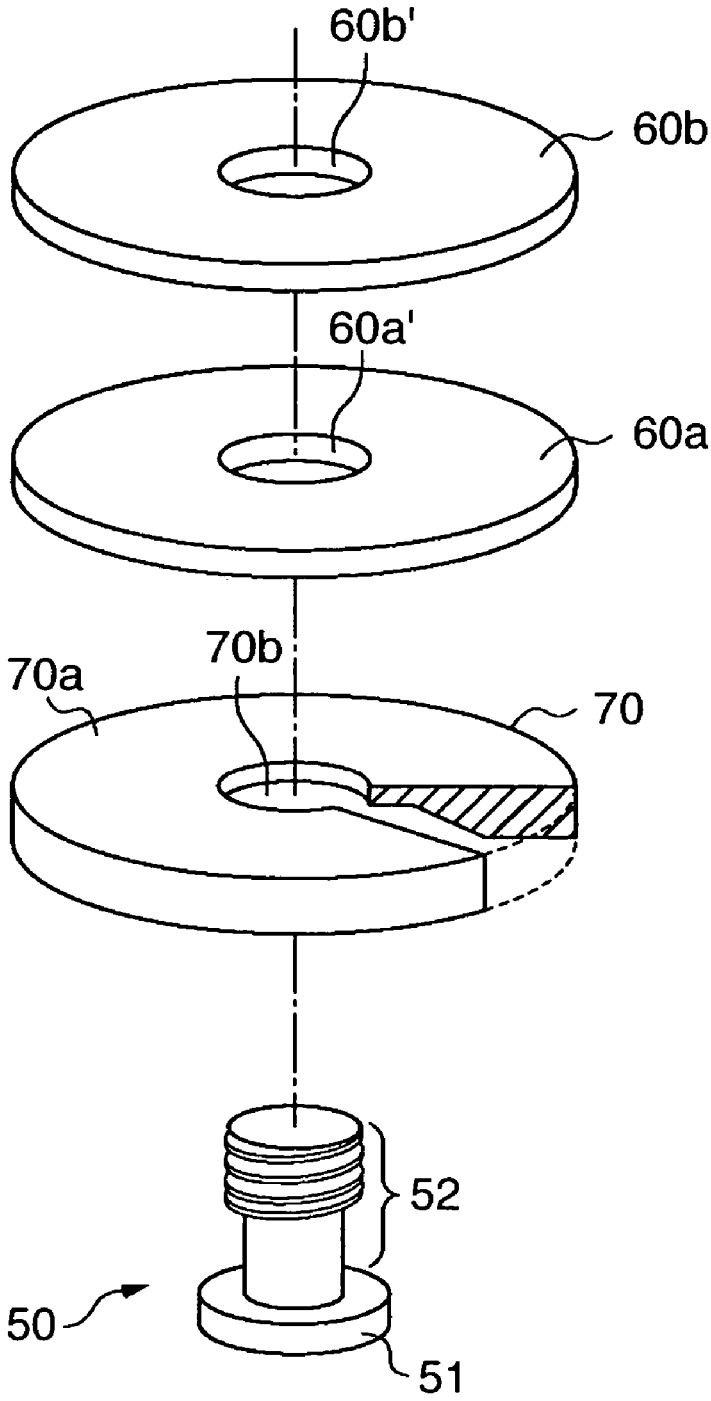
FIG. 2 is an exploded perspective view of the fixing structure of viscoelastic bodies.

A fixing member 50 threadably engages with a screw hole 41*b*. The fixing member 50 and an interposed member 70 fix the viscoelastic bodies 60*a* and 60*b*. FIG. 2 is an exploded perspective view of the fixing structure of the viscoelastic bodies, showing the viscoelastic bodies 60*a* and 60*b*, interposed member 70, and fixing member 50. In FIG. 2, the interposed member 70 is partially cutaway.

The fixing member 50 has a shaft body 52 formed with a threaded portion at its one end to threadably engage with the screw hole 41*b*, and a head portion 51 integrally connected to the other end of the shaft body 52. Both the viscoelastic bodies 60*a* and 60*b* form circular flat plates, and openings 60*a*' and 60*b*' where the shaft body 52 is to extend are formed at the central portions of the viscoelastic bodies 60*a* and 60*b*. Although the openings 60*a*' and 60*b*' are circular through holes, the present invention is not limited to this, and, e.g., a notch 60*c*' may be formed as in a viscoelastic body 60*c* shown in FIG. 3B. Although the viscoelastic bodies 60*a*, 60*b*, and 60*c* are circular, their shapes can be elliptic or have corners.

The viscoelastic bodies 60*a* and 60*b* are made of viscoelastic materials with loss coefficients (so-called tan δ) the temperature dependences of which are different. The temperature dependence of the loss coefficient of a viscoelastic material represents the degree of the vibration attenuating effect of the viscoelastic material at any given temperature, and is related to the degree of the vibration attenuating effect of the viscoelastic material at any given frequency. More specifically, relatively, whereas a viscoelastic material with a large loss coefficient at a low temperature provides a large vibration attenuating effect in a high frequency band, a viscoelastic material with a large loss coefficient at a high temperature provides a high vibration attenuating effect in a low frequency band. According to this embodiment, the viscoelastic bodies 60*a* and 60*b* made of viscoelastic materials with loss coefficients the temperature dependences of which are different from each other are employed simultaneously, to reduce vibration in a wider frequency range.

Examples of viscoelastic materials that form the viscoelastic bodies 60*a* and 60*b* include IIR (butyl bromide composition), NBR (acrylonitrile-butadiene rubber), natural rubber, silicone rubber, styrene-based rubber, and the like. The viscoelastic bodies 60*a* and 60*b* can also be formed by mixing a metal powder or the like in the viscoelastic materials described above to adjust their specific gravities.

Desirably, the viscoelastic bodies 60*a* and 60*b* are made of viscoelastic materials with loss coefficients the peak value temperatures of which are different. In general, the loss coefficient of a viscoelastic material gradually decreases at each temperature with respect to the peak value temperature as a peak. Therefore, when viscoelastic materials with loss coefficients the peak value temperatures of which are different are employed simultaneously, vibration in a wider frequency range can be reduced.

Both the viscoelastic bodies 60*a* and 60*b* are desirably made of viscoelastic materials with loss coefficients the peak values of which are 0.3 or more. If the loss coefficients are 0.3 or more, a higher vibration attenuating effect can be obtained.

Desirably, the peak value temperatures of the loss coefficients of one and the other of the viscoelastic material that forms the viscoelastic body 60*a* and the viscoelastic material that forms the viscoelastic body 60*b* are respectively less than −30° C. and −30° C. or more. The viscoelastic material with the loss coefficient the peak value temperature of which is less than −30° C. provides a relatively high vibration attenuating effect in the high frequency band, and the viscoelastic material with the loss coefficient the peak value temperature of which is −30° C. or more provides a relatively high vibration attenuating effect in the low frequency band. Therefore, vibration in a wider frequency range can be reduced.

The interposed member 70 is a member interposed between the viscoelastic bodies 60*a* and 60*b* and the head portion 51 of the fixing member 50, and serves to press the viscoelastic bodies 60*a* and 60*b* against the bottom portion 41*a* of the recess portion 41 substantially evenly. The interposed member 70 has a flat surface 70*a* with the same shape as the outer shape of each of the viscoelastic bodies 60*a* and 60*b*, and an opening 70*b* where the shaft body 52 is to extend is formed at the center of the interposed member 70. Although the opening 70*b* is a circular through hole, the present invention is not limited to this, and the opening 70*b* can be a notch in the same manner as in the viscoelastic body (FIG. 3B). The central portion of the interposed member 70 is thinner-walled than its circumferential portion. Thus, when the fixing member 50 is fixed to the recess portion 41, the head portion 51 of the fixing member 50 is partly buried in the interposed member 70.

In the golf club head A having the above structure, the shaft body 52 of the fixing member 50 is inserted in the openings 70*b*, 60*a*', and 60*b*' of the interposed member 70 and viscoelastic bodies 60*a* and 60*b*, and the threaded portion at the distal end of the shaft body 52 is threadably engaged with the screw hole 41*b*. Thus, the viscoelastic bodies 60*a* and 60*b* are fixed as they are sandwiched between the head portion 51 and bottom portion 41*a*.

In the golf club head A according to this embodiment, the viscoelastic bodies 60*a* and 60*b* made of viscoelastic materials with loss coefficients the temperature dependences of which are different from each other are employed simultaneously. Thus, vibration in a wider frequency range can be reduced.

As the viscoelastic bodies 60*a* and 60*b* form a structure through which the shaft body 52 of the fixing member 50 extends, the depth of the recess portion 41 can be made shallower, so that the viscoelastic bodies 60*a* and 60*b* can be fixed at a position closer to the circumferential wall (sole portion 40). Accordingly, the vibration damping effect of the viscoelastic bodies 60*a* and 60*b* can improve.

According to this embodiment, since the interposed member 70 is interposed between the head portion 51 and the viscoelastic bodies 60*a* and 60*b*, the viscoelastic bodies 60*a* and 60*b* can be pressed against the bottom portion 41*a* substantially evenly regardless of the size of the head portion 51, so that tight contact between the viscoelastic body 60*b* and bottom portion 41*a* can be ensured. This further improves the vibration damping effect. Due to the presence of the interposed member 70, the viscoelastic bodies 60*a* and 60*b* do not expose outside but are protected. Thus, the viscoelastic bodies 60*a* and 60*b* can be prevented from being damaged.

The fixing member 50 and interposed member 70 can also be used as members to adjust the barycentric position of the golf club head A. For example, the fixing member 50 and interposed member 70 can be made of a material having a specific gravity that is different from that of the circumferential wall of the golf club head A. When the circumferential wall of the golf club head A is made of a titanium alloy (specific gravity: about 4.5), if the fixing member 50 and interposed member 70 are made of stainless steel (specific gravity: about 7.8) or a tungsten alloy (specific gravity: about 13.0), the fixing member 50 and interposed member 70 can serve as weights as well, and the barycentric position of the golf club head A is closer to the portions of the fixing member 50 and interposed member 70. Conversely, if the fixing member 50 and interposed member 70 are made of an aluminum alloy (specific gravity: about 2.7), the barycentric position of the golf club head A is farther away from the portions of the fixing member 50 and interposed member 70.

According to this embodiment, the two viscoelastic bodies 60*a* and 60*b* are mounted in the golf club head A. However, three or more viscoelastic bodies can be mounted. In this case, desirably, the viscoelastic materials that form the respective elastic bodies have loss coefficients the temperature dependences of which are different from each other.

According to this embodiment, the two viscoelastic bodies 60*a* and 60*b* are fixed in the recess portion 41 in a stacked manner. However, the viscoelastic bodies 60*a* and 60*b* can be fixed at different portions. Examples of the portions to fix the viscoelastic bodies can include the side portion 30 and crown portion 20 in addition to the sole portion 40. If the viscoelastic bodies are fixed to sole portion 40, as in this embodiment, the barycenter of the golf club head A can be lowered. Hence, desirably, at least any one of a plurality of viscoelastic bodies is fixed to the sole portion. When a viscoelastic body is fixed to the back-side side portion 30, the barycenter of the golf club head A can be deepened.

Figure 3A:
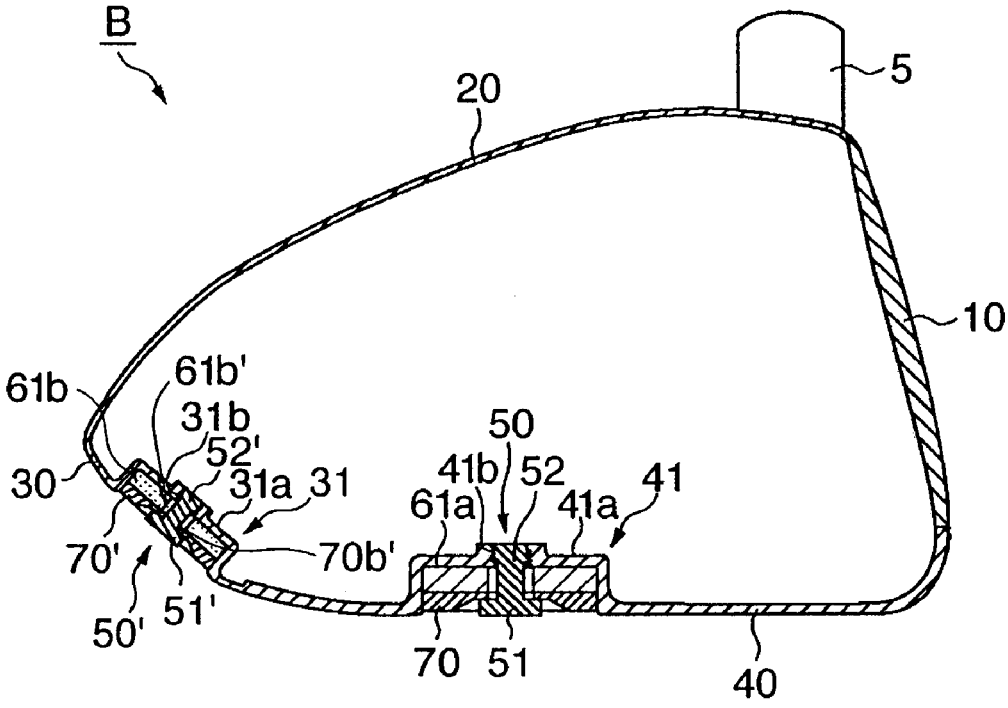
FIG. 3A is a sectional view showing the structure of a golf club head B according to another embodiment of the present invention.
Figure 3B:
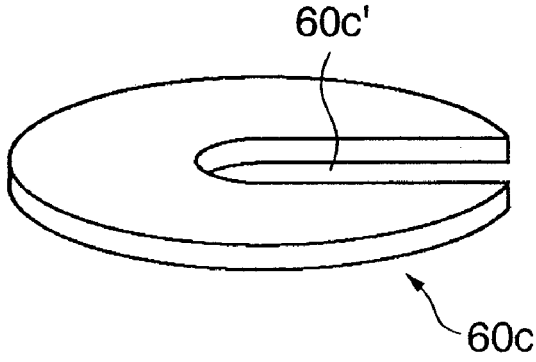
FIG. 3B is a view showing an example of the viscoelastic body.

FIG. 3A is a sectional view showing the structure of a golf club head B in which a plurality of viscoelastic bodies are fixed at a plurality of portions. In FIG. 3A, the same members as those of the golf club head A are denoted by the same reference numerals, and a description thereof will be omitted. In the golf club head B, a viscoelastic body 61*a* is fixed to a sole portion 40, and a viscoelastic body 61*b* is fixed to a back-side side portion 30. In the same manner as in the golf club head A, the viscoelastic bodies 61*a* and 61*b* are made of viscoelastic materials with loss coefficients the temperature dependences of which are different.

The fixing structure of the viscoelastic body 61*a* is the same as that of the golf club head A described above. The fixing structure of the viscoelastic body 61*b* is also the same as that of the golf club head A. A brief description will be made. A recess portion 31 extending into the golf club head B is integrally formed in the back-side side portion 30, and the viscoelastic body 61*b* is disposed in the recess portion 31. The recess portion 31 forms a fixing portion that is different from that of a recess portion 41. A screw hole 31*b* is formed in a bottom portion 31*a* of the recess portion 31. A fixing member 50' similar to a fixing member 50 threadably engages with the screw hole 31*b*. The fixing member 50' and an interposed member 70' which is similar to an interposed member 70 fix the viscoelastic body 61*b*. The fixing member 50' has a shaft body 52' formed with a threaded portion at its one end to threadably engage with the screw hole 31*b*, and a head portion 51' integrally connected to the other end of the shaft body 52'.

The shaft body 52' of the fixing member 50' is inserted in openings 70*b*' and 61*b*' of the interposed member 70' and viscoelastic body 61*b*, respectively, and the threaded portion at the distal end of the shaft body 52' is threadably engaged with the screw hole 31*b*. Thus, the viscoelastic body 61*b* is fixed as it is sandwiched between the head portion 51' and bottom portion 31*a*.

In the golf club head B with the above structure, separate vibration damping effects can be enhanced for the vibration occurring in the sole portion 40 and that in the side portion 30. As the viscoelastic body 61*b* and its fixing structure are disposed in the back-side side portion 30, the back side of the golf club head B becomes heavy to deepen the barycenter. As the viscoelastic body 61*a* and its fixing structure are disposed in the sole portion 40, the sole portion 40 side of the golf club head B becomes heavy to lower the barycenter. Therefore, with the golf club head B, in addition to the vibration damping effect, the barycenter can be lowered and deepened. The materials of the respective fixing members 50 and 50' and interposed members 70 and 70' of the two sets of the fixing structures may be the same or different. If the materials of the respective fixing members 50 and 50' and interposed members 70 and 70' are different, the barycentric position described above can be adjusted.

EXAMPLE & COMPARATIVE EXAMPLES

The golf club head A shown in FIG. 1 was subjected to comparison tests. The viscoelastic materials of the viscoelastic bodies 60*a* and 60*b* used in the example of the present invention and its comparative examples are as follows.

Example

Butyl bromide composition (the temperature dependence of the loss coefficient differs between the viscoelastic bodies 60*a* and 60*b*.)

Comparative Example 1

Styrene-based thermoplastic elastomer (the temperature dependence of the loss coefficient is the same between the viscoelastic bodies 60*a* and 60*b*.)

Comparative Example 2

Neither the viscoelastic body 60*a* nor the viscoelastic body 60*b* is loaded.

Figure 4A:
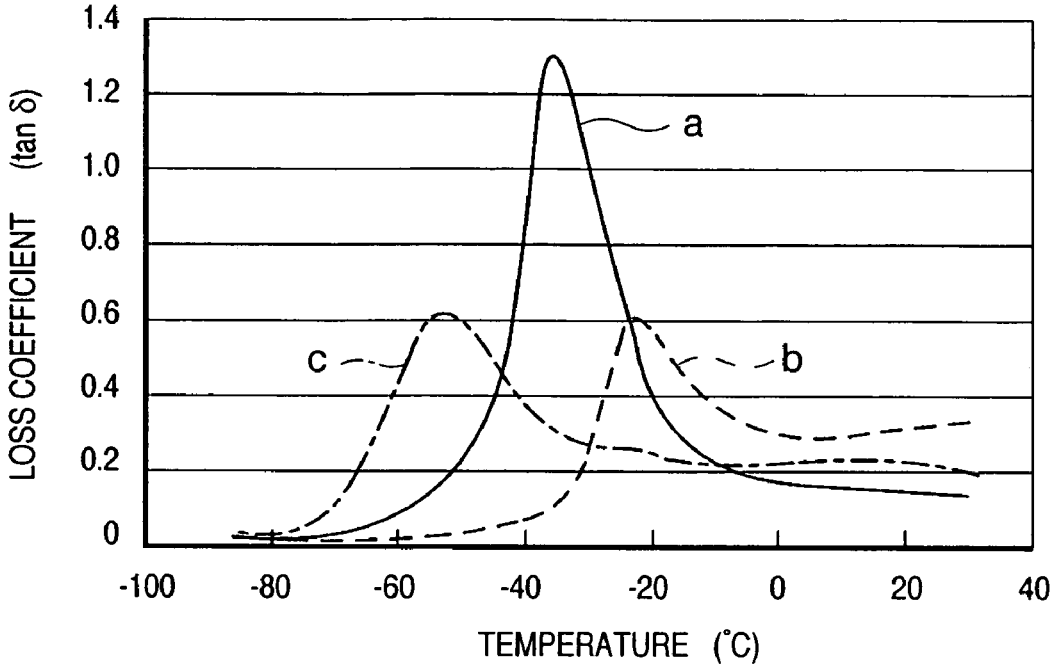
FIG. 4A is a graph showing the temperature dependences of the loss coefficients of the respective viscoelastic materials used in comparative experiments.

FIG. 4A is a graph showing the temperature dependences of the loss coefficients of the respective viscoelastic materials used in the experiments, and shows the temperature dependences at the vibration of 1 Hz. Referring to FIG. 4A, a line a represents the temperature dependence of the loss coefficient of the viscoelastic material (butyl bromide composition) used to form the viscoelastic body 60*a* of the example. A line b represents the temperature dependence of the loss coefficient of the viscoelastic material (butyl bromide composition) used to form the viscoelastic body 60*b* of the example. A line c represents the temperature dependence of the loss coefficient of the viscoelastic material (styrene-based thermoplastic elastomer) used to form the viscoelastic bodies 60*a* and 60*b* of Comparative Example 1.

The respective viscoelastic materials used to form the viscoelastic bodies 60*a* and 60*b* of the example have loss coefficients the peak value temperatures of which are different, and the peak values of their loss coefficients are both 0.3 or more. The peak value temperature of the loss coefficient of the viscoelastic material of the viscoelastic body 60*a* is less than −30° C. The peak value temperature of the loss coefficient of the viscoelastic material of the viscoelastic body 60*b* is −30° C. or more.

Figure 4B:
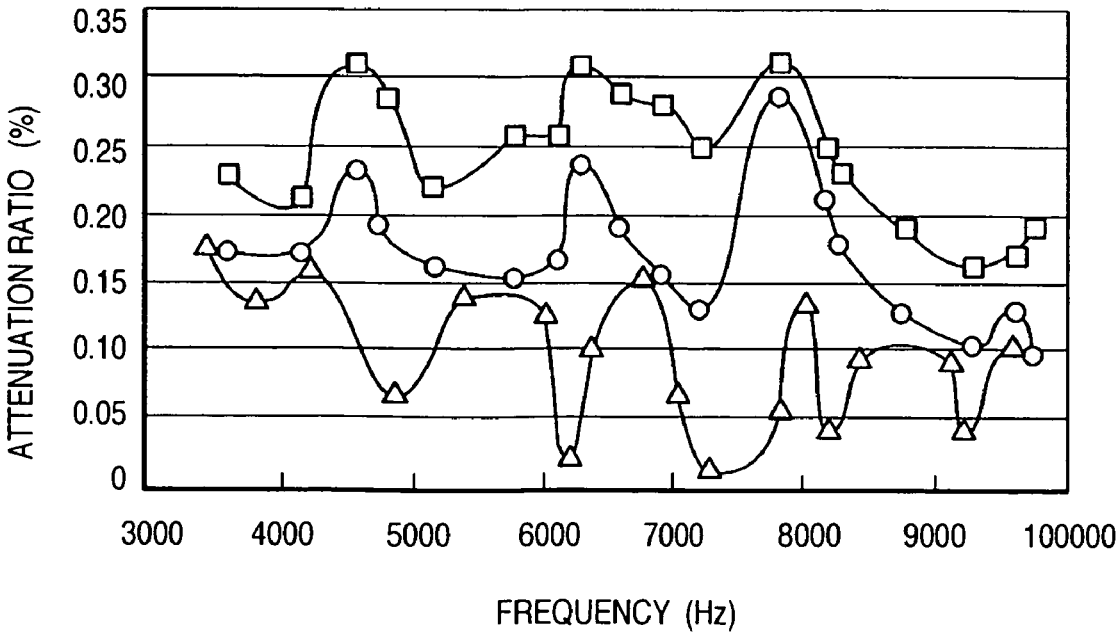
FIG. 4B is a graph showing the result of the vibration measurement experiment for golf club heads according to the example and Comparative Examples 1 to 3.

FIG. 4B is a graph showing the result of the vibration measurement experiment for golf club heads according to the example and Comparative Examples 1 and 2. In FIG. 4B, the attenuation ratios are calculated by modal analysis. The plots in FIG. 4B indicate the attenuation ratios of the resonance frequencies of the respective golf club heads. Square plots indicate the example, solid circle plots indicate Comparative Example 1, and triangular plots indicate Comparative Example 2. In the example, a high attenuation ratio is obtained in a wide frequency range.

As many apparently widely different embodiments of the present invention can be made without departing from the spirit and scope thereof, it is to be understood that the invention is not limited to the specific embodiments thereof except as defined in the appended claims.

This application claims the benefit of Japanese Application No. 2005-351280, filed Dec. 5, 2005, which is hereby incorporated by reference herein in its entirety.

What is claimed is:

1. A hollow golf club head comprising:

a first recess portion formed in a portion of said head;

a second recess portion formed in another portion of said head;

a first viscoelastic body made of a first viscoelastic material, said first viscoelastic body fixed in said first recess portion;

a second viscoelastic body made of a second viscoelastic material, said second viscoelastic body fixed in said second recess portion;

a first cover member provided with said first recess portion and covering the whole first viscoelastic body; and a second cover member provided with said second recess portion and covering the whole second viscoelastic body, wherein said first viscoelastic material has a peak value temperature of the loss coefficient which is less than −30° C. and said second viscoelastic material has a peak value temperature of the loss coefficient which is not less than −30° C., wherein said first viscoelastic material comprises one of a butyl bromide composition, an acrylonitrile-butadiene rubber, silicone rubber and styrene-based rubber, and said second viscoelastic material comprises one of a butyl bromide composition, an acrylonitrile-butadiene rubber, silicone rubber and styrene-based rubber, and wherein said first recess portion is formed in a sole portion of said head, and said second recess portion is formed in a side portion of said head.

2. The head according to claim 1, wherein a peak value of the loss coefficient of the first viscoelastic material and a peak value of the loss coefficient of the second viscoelastic material are both not less than 0.3.

3. The head according to claim 1, further comprising a fixing portion provided to a circumferential wall of the golf club head for fixing said first viscoelastic body and said second viscoelastic body in a stacked manner.

4. The head according to claim 1, wherein said head comprises any one of a wood type golf club head and utility type golf club head.

5. A hollow golf club head comprising:

a first recess portion formed in a portion of said head;

a second recess portion formed in another portion of said head;

a first viscoelastic body made of a first viscoelastic material, said first viscoelastic body fixed in said first recess portion;

a second viscoelastic body made of a second viscoelastic material, said second viscoelastic body fixed in said second recess portion;

a first cover member provided with said first recess portion and covering the whole first viscoelastic body; and a second cover member provided with said second recess portion and covering the whole second viscoelastic body, wherein said first viscoelastic material has a peak value temperature of the loss coefficient which is less than −30° C. and said second viscoelastic material has a peak value temperature of the loss coefficient which is not less than −30° C., wherein said first viscoelastic material comprises a butyl bromide composition and said second viscoelastic material comprises a butyl bromide composition, and wherein said first recess portion is formed in a sole portion of said head, and said second recess portion is formed in a side portion of said head.

* * * * *